US005628133A

United States Patent [19]

Cooper

[11] Patent Number: 5,628,133

[45] Date of Patent: May 13, 1997

[54] RAPID ACTIVATION CAR WINDOW SIGN

[76] Inventor: Glenn M. Cooper, Box 21, Mansfield, Ontario, Canada, L0N 1M0

[21] Appl. No.: 472,286

[22] Filed: Jun. 7, 1995

[51] Int. Cl.[6] ..... G09F 21/04

[52] U.S. Cl. ..... 40/591; 40/593

[58] Field of Search ..... 40/593, 610, 597, 40/511, 473, 591

[56] References Cited

U.S. PATENT DOCUMENTS

| | | | |
|---|---|---|---|
| 3,007,435 | 11/1961 | Peterson | 40/597 X |
| 3,256,629 | 6/1966 | Whitman | 40/610 |
| 3,383,788 | 5/1968 | Patzer | 40/593 |
| 3,696,537 | 10/1972 | Alleman | 40/511 |
| 3,914,890 | 10/1975 | Behlen, Jr. | 40/597 |
| 4,021,946 | 5/1977 | Bradshaw | 40/473 |
| 4,574,269 | 3/1986 | Miller | 40/593 X |
| 4,999,938 | 3/1991 | Behling | 40/610 |

*Primary Examiner*—Joanne Silbermann
*Attorney, Agent, or Firm*—Eugene J. A. Gierczak

[57] ABSTRACT

A removable car sign is provided for temporary installation on the inside face of the window of a car. A pneumatic bulb is placed conveniently near the driver's console. When the bulb is squeezed by the car driver it causes the sign to extend to an open position in which a message is visible from the outside of the car. When the bulb is released the sign returns to its closed position in which the message is not viewable. The message surfaces may be easily removed and replaced as one may desire.

13 Claims, 5 Drawing Sheets

RAPID ACTIVATION CAR WINDOW SIGN

FIELD OF INVENTION

This invention relates to signs which may be deployed inside car windows for external viewing, and, in particular, to a sign which is generally stored with its message hidden from view, which may be rapidly deployed for viewing while the vehicle is in motion, and may be retracted to the stored position

BACKGROUND ART

Signs for display in car windows are well known. In all cases the sign is deployed inside the vehicle with the message of the sign oriented to be viewed by persons outside the vehicle.

The prior art includes signs intended for longer term advertising, such as the "Eat at Joe's" sign disclosed in U.S. Pat. No. 4,258,492 to Williams. This embodiment includes a frame to be mounted inside the window frame as may be convenient.

Another relatively permanent display is shown in U.S. Pat. No. 5,016,145 to Singleton in which an illuminated signboard, with a festive natal message is displayed through the rear window of a pick-up truck. The structure is mounted to the inside face of the rear window by means of suction cups.

A third form of relatively permanent structure is shown in U.S. Pat No. 5,069,376 to Barel. In this instance a formed sign holder is positioned between the rearwardly sloping inner face of a front windshield and the upper surface of the front dashboard. The holder permits insertion of, for example, a handicapped person or wheelchair sign, or a camping facility permit. Although the sign holder itself is stationary once installed the permit or sign may be removed and replaced as desired.

More interesting devices are shown in U.S. Pat. No. 4,864,754 to Sangu and U.S. Pat. No. 5,010,670 to Minervini. Both of these documents reveal signs which move from a stored position to a display position as the result of operation of a mechanism. The Sangu device includes not only an embodiment with a sophisticated microprocessor controlled system linked to the brake pedal and speedometer, but also a further embodiment comprising a geared prismatic array upon whose sides three messages may be arranged, in the manner of the well known revolving roadside billboards. For all its complexity the main Sangu embodiment is not a sign that is controlled by the driver to send display arbitrary messages to other drivers, but is, by contrast a display ancillary to the function of braking. The driver does not activate the sign itself, but rather the sign is incidentally, and indirectly activated by the action of stopping the car. The display may be installed on the rear decking behind the rear seat of a passenger sedan, or suspended from the roof. The Sangu device is clearly intended to be a permanent fixture within the vehicle.

Minervini discloses a movable sign of less permanence than Sangu, intended to be held in place by clips introduced between the inner lip of a window seal and the glass panel. Frequent removal and re-insertion of these clips would not improve the service life of the window seal, and might well lead to scratches of the interior panels of the vehicle. A lanyard extends from the distal extremity of an hinged, depending panel forward to a position within the reach of the conductor. This lanyard, and its operation, demonstrate certain disadvantages. First, the driver must reach up, while the car is in motion, and release the hook by which the lanyard is caught about the rear view mirror stanchion. Once the "DIM" sign has been lowered to its deployed position the driver may be hesitant to release the lanyard, for fear that, in the dark interior of the vehicle, it may not be easy to find. It would be an undesirable distraction for a driver to be groping about the upholstery for such a lanyard rather than attending to the hazards of the road. Further, the location of the hook upon the rearview mirror stanchion itself would seem to increase the likelihood that a less dextrous driver would disturb the orientation of the mirror from its chosen position. Finally, the rearwardly extending lanyard may present a snare to entangle persons entering or departing the vehicle. The depending embodiment of this sign, and of the similar depending embodiment of Sangu suggest that those seated in the rear seat had best not be of great stature, or that the sign may only be deployed when there are no passengers' heads obstructing the arc to be swept by the sign during deployment.

Finally, none of the examples of prior an describe a sign whose message is fully hidden from view when not in use. Even the folding signs of Minervini and Sangu are visible in their storage positions either to pedestrians who may view the message when the car is parked, or by persons seated within the car.

There is therefore, a need for a relatively uncomplicated movable sign for deployment within a vehicle, which neither requires an inconvenient lanyard nor a complicated microprocessor control system, which will return to its stored position without fuss, which may be activated and de-activated quickly, which will conceal its own message when not in use, which may be deployed with reduced potential for distraction of the driver, and whose deployment will not be obstructed by the heads of persons who may be seated in the rear seat.

DESCRIPTION OF THE INVENTION

The present invention concerns an externally viewable car sign for installation within an automobile, that sign comprising at least one message surface and an extensible member movable from a first, hidden storage position in which the message surface is not visible, to a second, extended visible position in which that message surface is externally viewable.

In one aspect of the invention the sign has an actuator assembly for activation by a driver of the automobile to cause motion of the sign from the first position to said second position; and may further comprise a grip adjacent to and for operation by the driver for generating a signal; a display standard upon which to mount that extensible member; a transducer for convening signals emanating from the grip to motion of the extensible member; and communication means intermediate the grip and the transducer for receiving signals from the grip and transmitting those signals to the transducer, whereby the driver can use the grip to move the sign from the first position to the second position; and that grip may be a squeezable bulb, the communication means may be a flexible tube, and the transducer means may comprise an expansible bladder, whereby compression of said bulb causes expansion of said bladder.

In another aspect of the invention suitable for use with a car which comprises floor mats and doors having door frames and door sills, at least a portion of the tube is disposed in contact with said mats and at least a portion of the tube is disposed adjacent to the door sills and door frames whereby the tube permits unobstructed entry and exit of the car.

In yet another aspect of the invention there is an externally viewable car sign comprising a display standard upon which to mount the extensible member; a first wing; an hinge intermediate the standard and the first wing; that first wing hingedly mounted to the standard for pivotal motion about the hinge; that first wing comprising a first message surface upon which at least a portion of a message for display has been arranged; that first, staff, wing pivotally movable about the first hinge from a first position in which the first message surface is hidden from view, to a second, extended visible position in which the message surface is externally viewable; and which may comprise further aspects, including a second, distaff, wing; a hinge intermediate the first, staff, wing and that second, distaff wing; the second, distaff, wing pivotally movable about the second hinge relative to the first, staff wing; that second, distaff wing comprising a second message surface on which at least a portion of a message for display has been arranged; the second, distaff wing pivotally movable about the second hinge relative to the first, staff, wing from a first position in which the second message surface is hidden from view to a second, extended position in which the message is externally visible.

In other aspects of the invention the externally viewable car sign comprises a return biasing device for urging the sign to that first, hidden position; the standard, and hence the sign itself, is removably mounted to a glass surface of said automobile by means of suction cups; and the extensible member is detachably mounted to the display standard whereby the extensible member may be removed and a substitute extensible member with a different message installed in its stead.

BRIEF DESCRIPTION OF DRAWINGS

FIG. 2, comprising

FIG. 3 comprising

BEST MODE FOR CARRYING OUT THE INVENTION

Figure 1:
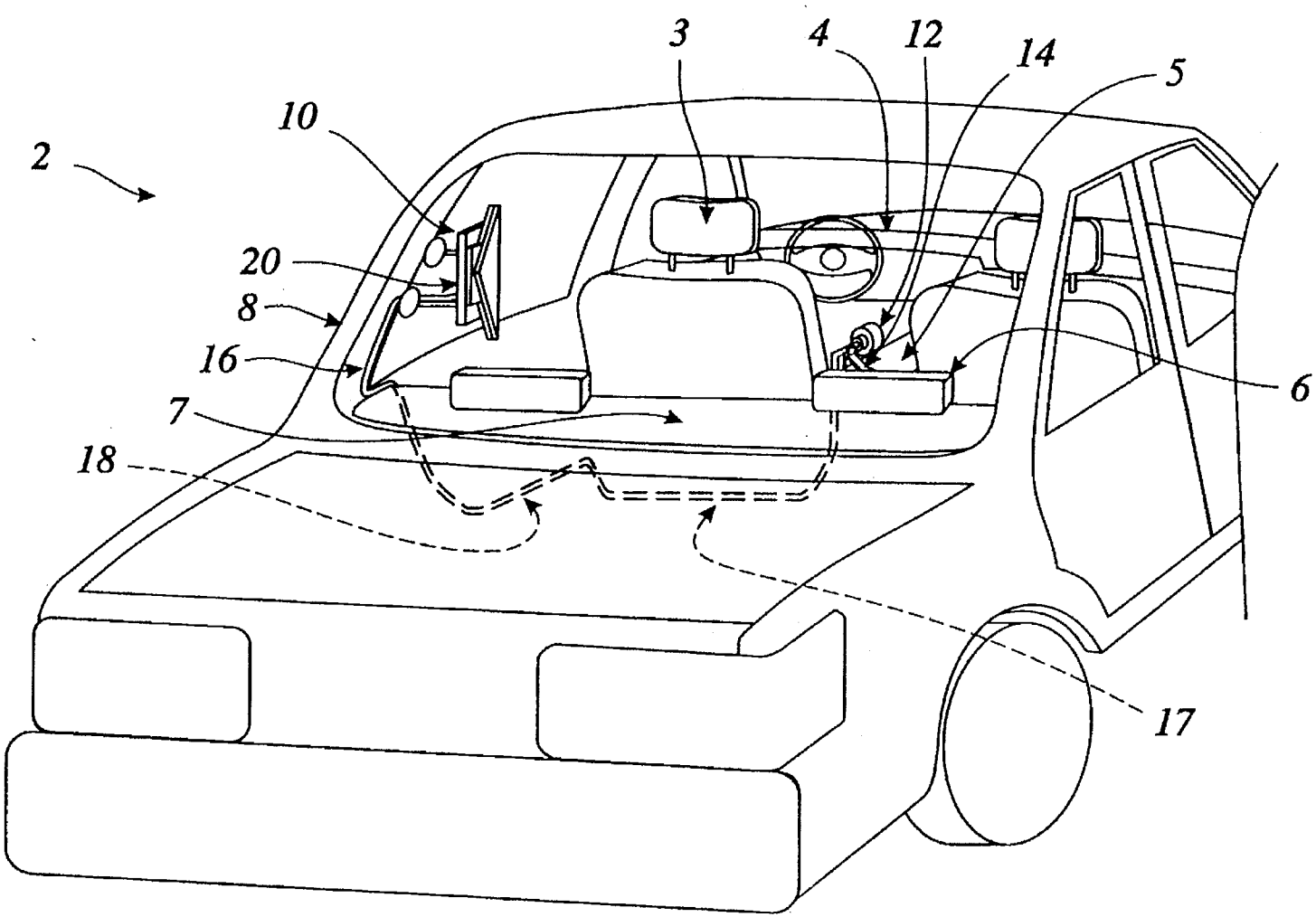
FIG. 1 is a general arrangement illustration of a retractable folding window sign of the present invention.
Figure 2A:
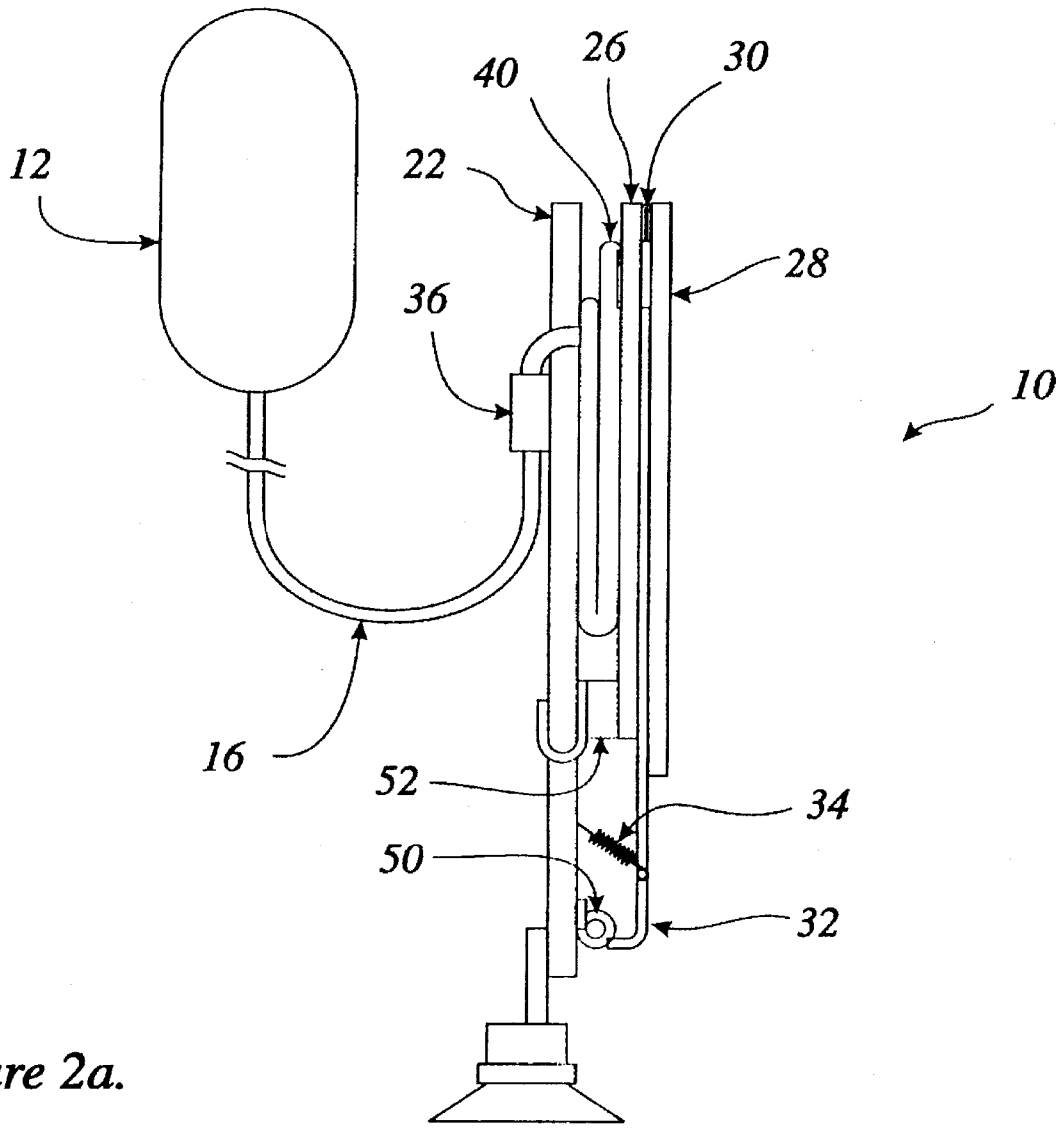
FIGS. 2*a* and 2*b*, shows downward looking views of the sign of FIG. 1 in its retracted and extended positions respectively.
Figure 2B:
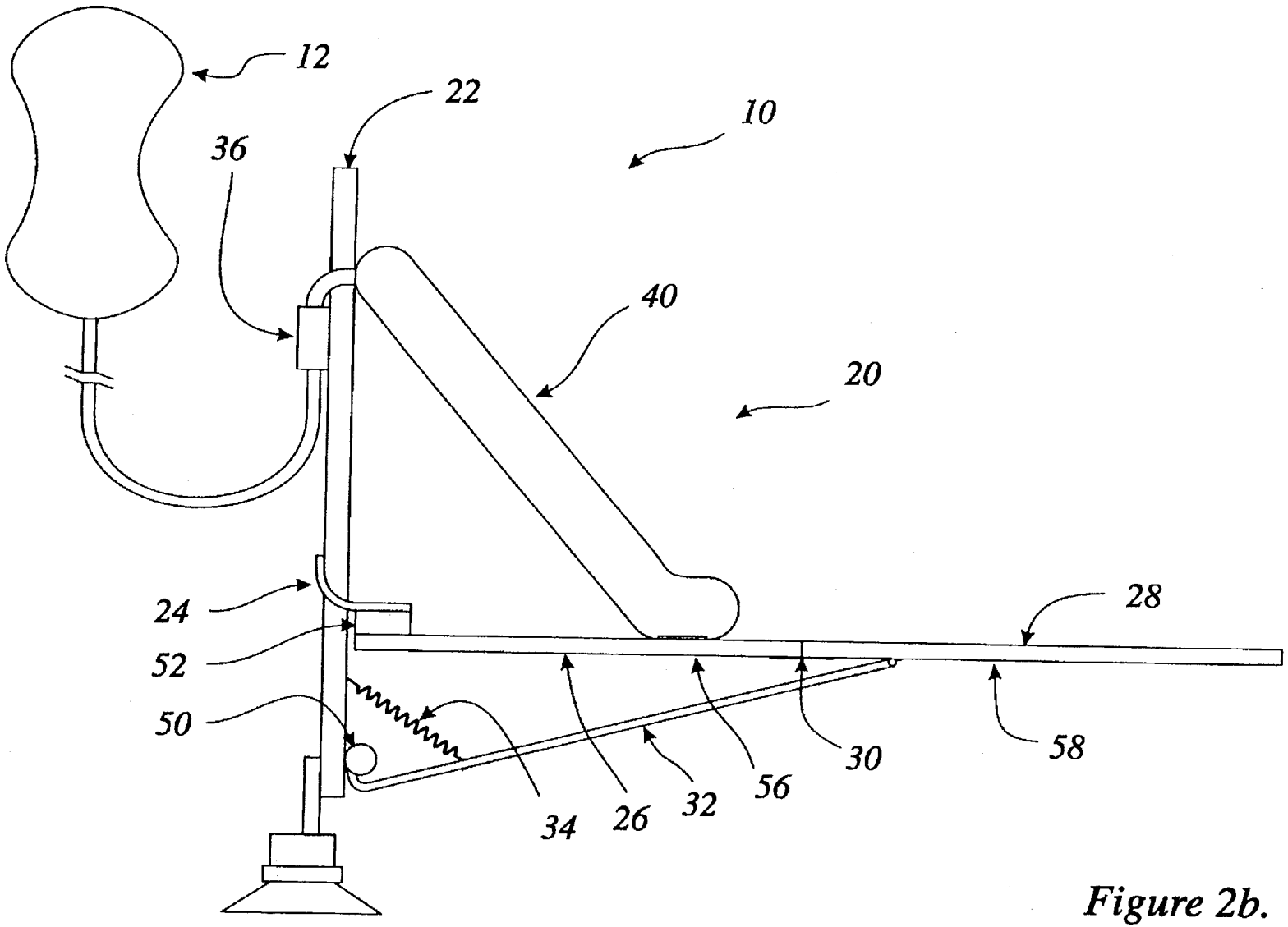
Figures 3A, 3B:
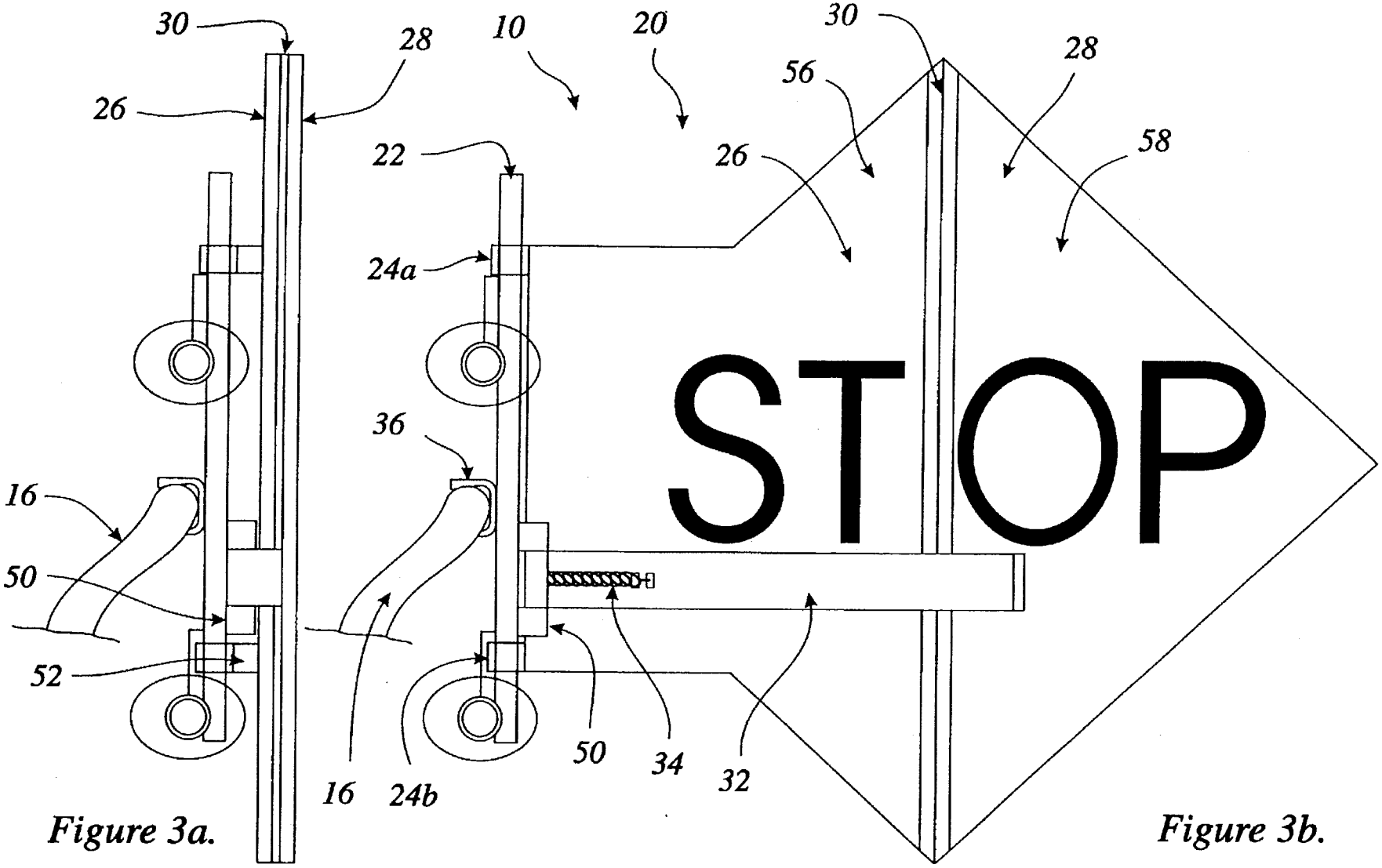
FIGS. 3*a* and 3*b*, show horizontal views of the sign of FIG. 1, again in retracted and extended positions respectively.
Figure 4:
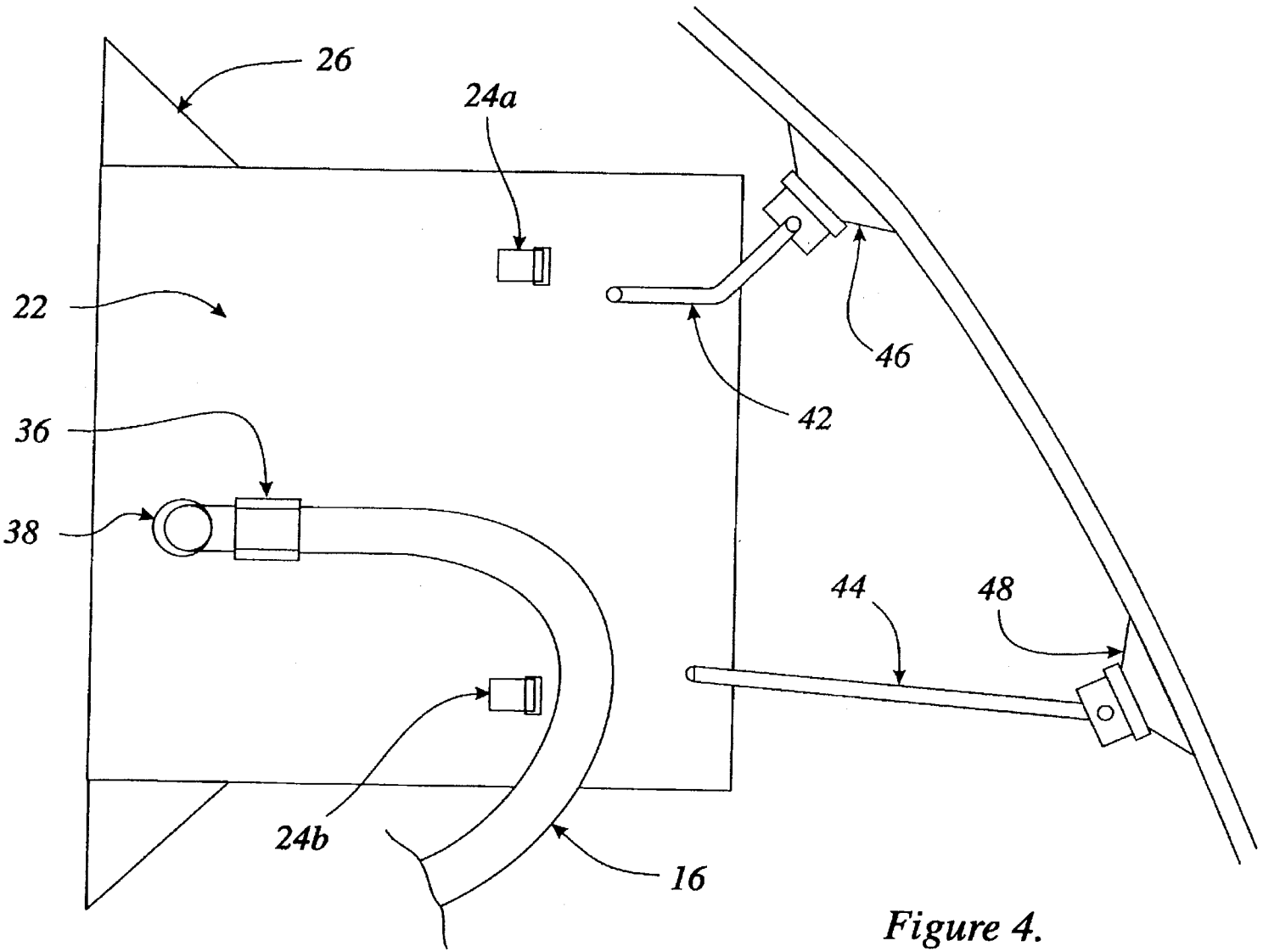
FIG. 4 shows a left hand profile view of the sign of FIG. 1 showing more particularly means by which to mount that sign to a rear window.

Commencing with FIG. 1, a car interior is shown generally as 2, having a driver's seat 3 and front dashboard 4 and console 5. A rear seat is shown as 6, rear decking as 7 and a rear quarter piller as 8. These features are shown for illustration and form no part of the present invention.

One observes the retractable window sign system of the present invention indicated generally as 10. A grip, in this case a compressible hand bulb, or bladder, for squeezing is shown as 12. In the preferred embodiment bulb 12 is mounted to the control console 5 by means of a convenient clip 14, although other mechanically equivalent means would serve as well. For example, bulb 12 could be operated by a foot pedal or floor switch such as were frequently used in former times for high beam switches. A communication means in the form of a flexible hollow tube 16, mates with and extends from hand bulb 12 along an unobtrusive path to the retractable signage mechanism shown generally as 20. Tube 16 can be cut to any desired length. In the preferred embodiment a first portion 17, shown in dashed lines in FIG. 1, is arranged to run along or under the carpeting to the side walls of the vehicle interior and then a second portion 18, also shown in dashed lines, runs adjacent, within and below the door sills and jambs and generally rearward and upward to terminate in the vicinity of the rear decking. In this manner, entry and exit from the vehicle is not impeded.

Retractable signage mechanism 20 comprises a display standard or mounting base frame 22; a first hinge 24; a first, staff panel 26 connected thereto and disposed for pivotal motion therefrom; a distaff panel 28 extending from the distal edge of staff panel 26 by means of a second hinge 30 deployed substantially parallel to first hinge 24 to permit pivotal motion of distaff panel 28 thereabout with respect to staff panel 26; a strut 32; a return spring 34; a clip 36; an aperture 38 through frame 22; and an expansion bulb, or bladder, 40. Signage mechanism 20 is further provided with mounting hardware, such as the upper and lower legs 42 and 44, respectively, giving onto corresponding suction cup upper and lower feet 46 and 48.

Mounting base frame 22 need not be a rectangular planar panel. It could equivalently be a structure formed from beam elements or a number of other mechanical equivalents. First hinge 24 is shown to have well spread upper and lower hinge elements 24*a* and 24*b* seated on frame 22. Hinge 30 may be a conventional hinge, such as a piano hinge, or be a sheet of flexible material, or, as in the preferred embodiment, comprise the top sheet of a multiply sandwich that has been scored and bent. Many mechanical equivalents are known. Strut 32 is mounted to frame 22 by means of a hinge 50. The opposite end of strut 32 is detachably affixed to second wing member 28. In the preferred embodiment this may be achieved with the well known strips of hook and eye fabric pile fasteners. Ideally, when extended, the first and second wings members, 26 and 28, respectively, extend substantially perpendicular to frame 22. Since hinge 30 cannot open past the 180 degree orientation, the placement of hinge 50 along the plane of frame 22 and the length of strut 32 define the angular orientation of the wings members to frame 22 in the open position. Strut 32 ideally forms the hypotenuse of a right angled triangle having as its base the distance between hinge 24 and hinge 50. Strut 32 has a gull wing, and a standoff 52 is located intermediate hinge 24 and first wing member 26. This permits wing members 26 and 28 to lie flat against each other, and substantially parallel to frame 22 in the retracted position, while bladder 40 may collapse in the space provided by standoff 52 between first wing 26 and the standard, or frame, 22. First wing member 26 and second wing member 28 each have a first message surface, 56 or 58, on which a desired graphic display may be arranged. In the retracted position these two message surfaces 56 and 58 are in opposed, substantially planar contact whereby the message is completely hidden from view. It will be appreciated that an accordion mechanism employing a plurality of foldable panels could be employed to similar effect. In the preferred embodiment shown the diamond shaped sign is formed from two triangular halves. The choice of shape is arbitrary, and others shapes could as easily be chosen.

Sign mechanism 20 is intended to be mounted to any smooth interior surface, such as the smooth inner surface of a rear window, a side window, or dashboard. A number of means may be chosen for this purpose. Since the preferred embodiment is intended to be easily installed and removed, suction cups are provided. These may be located and removed at will. Legs 42 and 44 are rigidly mounted to frame 22. The desired placement of sign mechanism 22 is achieved by plastic deformation bending of legs 42 and 44 to any position desired to suit a particular rear window. It would be equivalent to provide a number of stiff jointed articulated legs, and one may as easily choose three or more legs. In the preferred embodiment wing members 26 and 28 are made from hollow cell paper skinned board which weighs very little, imposing only slight structural loads.

In the sign of the preferred embodiment is located in the rear dashboard near the left hand rear quarter pillar. In this position it is in an area which is usually already in a blind spot. As such, when folded, the sign presents minimal obstruction to the driver's view. In operation the squeezing of bulb 12 will necessarily cause expansion of bladder 40, bulb 12 and bladder 40 being in fluid communication with each other through the communication means provided by pneumatic tube 16. Bulb 12 serves the function of an activator mechanism, pneumatic tube 16 is a communication means, and bladder 40 is a transducer by which the pneumatic signal sent from bulb 12 and communicated by tube 16 is converted to motion of the extensible member comprising foldable message surfaces 56 and 58. A hydraulic system could also be used, but would require a working fluid which could well leak. Similarly an electrical system, whether with relays of with a microprocessor, or a bicycle cable-and-wire apparatus could be designed to serve the same purpose. A pneumatic system has the virtue of relative simplicity, and light weight. It is well suited for self-installation by a purchaser. Further, one may choose a sign having not only graphic images, but also images which are themselves inflatable. In addition, one may also employ electrical elements, such as lights and a battery.

The pneumatic system of the preferred embodiment also permits one to "flash" the message very rapidly, and briefly, at a following driver by first grasping, then releasing conveniently located bulb 12. Return spring 34 is disposed to extend from frame 22 to strut 32, although it could, alternatively, be disposed to extend from frame 22 to first wing member 26. In either case return spring 34 encourages a quick return action. A driver may use this sign with relatively small risk of distraction from the dangers of the road. Moreover, due to the location of the sign, and the lateral extension, there is little risk that the sign will knock passengers in the head.

First and second wing members 26 and 28 are held in place at each of their pivot points by hook and eye pile fasteners. This permits easy removal of a sign having one message, and a replacement with a sign having a second message.

While a particular embodiment of the present invention has been described it will be understood by those skilled in the art that a number of mechanically equivalent elements could be employed without departing from the scope of the present invention as set out in the claims hereafter.

I claim:

1. An externally viewable car sign for installation within an automobile, said sign comprising a first staff wing having a first message surface with at least a first portion of the message arranged thereon;

a second distaff wing having a second message surface with at least a second portion of a message arranged thereon;

a display standard;

a first hinge intermediate said display standard and said first wing for mounting said first staff wing hingedly thereto for pivotal motion relative to said display standard;

a second hinge intermediate a distal portion of said first staff wing and said second distaff wing for mounting said second distaff wing hingedly thereto for pivotal motion of said second distaff wing relative to first staff wing;

an actuator assembly for activation by a driver of said automobile to cause motion of said sign from said first position to said second position, comprising;

a grip adjacent to and for operation by said driver for generating a signal;

a transducer for converting signals from said grip to motion of said first staff wing and said second distaff wing; and a communication means intermediate said grip and said transducer for receiving signals from said grip and transmitting those signals to said transducer, whereby said driver can use said grip to move said sign from a first hidden position to a said second viewable position in which said message surface is externally viewable;

wherein said grip is a squeezable bladder, said communication means is a flexible tube, and said transducer means comprises an expansible bulb, whereby compression of said squeezable bladder causes expansion of said expansible bulb.

2. The externally viewable car sign of claim 1 wherein said actuator assembly is pneumatic.

3. The externally viewable car sign of claim 1 wherein said squeezable bladder is a hand bulb.

4. The externally viewable car sign of claim 1 wherein said squeezable bladder is operated by a foot pedal.

5. The externally viewable car sign of claim 4 in which in said first position of said first staff wing, and in said first position of said second distaff wing, said first message surface is in opposed abutting relationship to said second message surface whereby each of said first and second messages surfaces is hidden from view.

6. The externally viewable car sign of claim 4 comprising a strut having two ends, a first of said ends pivotally mounted to said display standard and a second of said ends mounted to said second distaff wing;

said first end offset from said first hinge;

said display standard having a base member extending from said first hinge to said first end of said strut;

whereby in said second positions of said first staff, and said second distaff wings those wings are substantially co-planar and said wings are restrained by said strut to lie in a plane perpendicular to said base member.

7. The externally viewable car sign of claim 4 wherein said car sign comprises a return biasing device intermediate said base and one of a) said strut or b) said first staff wing, for urging said sign to said first, hidden position.

8. The externally viewable car sign of claim 4 wherein said sign comprises a plurality of wings and alternating hinges therebetween, said wings and hinges extensible from said display standard to a first extended position, and retractable to a second accordion folded storage position.

9. The externally viewable car sign of claim 4 wherein said expansible bulb comprising an inlet in fluid communication with said squeezable bladder through said communication means, said inlet restrained by a locating clip, and an extremity of said bulb detachably connected to said extensible member whereby expansion of said bulb causes said extensible member to move from a first, hidden position to a second, extended position.

10. The externally viewable car sign of claim 1 wherein release of said squeezable bladder causes said sign to return from said second, extended, visible position to said first, hidden, storage position.

11. The externally viewable car sign of claim 1 wherein said standard is removably mounted to a glass surface of said automobile by means of suction cups.

12. An externally viewable car sign for installation within an automobile, said sign comprising at least one message surface;

an extensible member movable from a first, hidden storage position in which said message surface is not visible, to a second, extended visible position in which said message surface is externally viewable;

a pneumatic actuator assembly for activation by a driver of said automobile to cause motion of said sign from said first position to said second position, comprising;

a grip adjacent to and for operation by said driver for generating a signal;

a display standard upon which to mount said extensible member;

a transducer for converting signals from said grip to motion of said extensible member; and a communication means intermediate said grip and said transducer for receiving signals from said grip and transmitting those signals to said transducer, whereby said driver can use said grip to move said sign from said first position to said second position;

a first staff wing;

a first hinge intermediate said display standard and said first wing;

said first staff wing hingedly mounted to said display standard for pivotal motion about said first hinge;

said first staff wing comprising a first message surface upon which at least a portion of said message for display has been arranged;

said first staff wing pivotally movable about said first hinge from said first position in which said first message surface is hidden from view, to said second, extended visible position in which said message surface is externally viewable;

a second distaff wing;

a second hinge intermediate said first staff wing and said second distaff wing;

said second distaff wing pivotally movable about said second hinge relative to said first staff wing;

said second distaff wing comprising a second message surface on which at least a portion of a message for display has been arranged;

said second distaff wing pivotally movable about said second hinge relative to said first staff wing from a first position in which said second message surface is hidden from view to a second, extended position in which said message is externally visible;

wherein said grip is a hand bulb, said communication means is a flexible tube, and said transducer means comprises an expansible bulb, whereby compression of said squeezable bladder causes expansion of said expansible bulb.

13. An externally viewable car sign for installation within an automobile, said sign comprising:

a first staff wing having a first message surface with at least a first portion of a message arranged thereupon;

a second distaff wing having a second message surface with at least a second portion of a message arranged thereupon;

a display standard removably affixed to a glass surface of said automobile, said display standard comprising a base member having a first, strut mounting location, a second, transducer mounting location, and a third, return spring mounting location;

a first hinge intermediate said display standard and said first staff wing for mounting said first staff wing hingedly thereto for pivotal motion relative to said display standard;

a second distaff wing;

a second hinge intermediate a distal portion of said first staff wing and said second distaff wing for mounting said second distaff wing hingedly thereto for pivotal motion of said second distaff wing relative to said first staff wing;

a strut having two ends, a first of said ends mounted to said base at said strut mounting location, and the other of said ends mounted to said second distaff wing;

a return spring having a first end mounted to said base at said third, return spring mounting location and a second end mounted to one of a) said strut or b) said first staff wing, for biasing said first staff wing to a first, hidden position;

an actuator assembly comprising a first pneumatic bulb disposed adjacent a control console of said automobile, a communication tube, and a second pneumatic bulb;

said communication tube intermediate said first pneumatic bulb and said second pneumatic bulb and providing communication therebetween, the compression of said first bulb causing expansion of said second bulb;

said second bulb affixed to said base;

said second bulb comprising an inlet affixed to said communication means and a distal portion affixed to said first staff wing;

said sign movable from a first, hidden position to a second, viewable position;

whereby compression of said first bulb causes said sign to move from said first, hidden position to said second, viewable position, and subsequent release of said first bulb allows said return spring to urge said sign to return to said first, hidden position.

* * * * *